US006629377B2

(12) United States Patent
Taraschuk

(10) Patent No.: US 6,629,377 B2
(45) Date of Patent: Oct. 7, 2003

(54) PRINTED ARTICLE WITH FLOATING INSERT

(76) Inventor: Mikhail V. Taraschuk, Turgeneva Str. 164, Apt. 10, Krasnodar (RU)

( * ) Notice: Subject to any disclaimer, the term of this patent is extended or adjusted under 35 U.S.C. 154(b) by 0 days.

(21) Appl. No.: 10/010,200

(22) Filed: Nov. 5, 2001

(65) Prior Publication Data

US 2002/0129520 A1 Sep. 19, 2002

(30) Foreign Application Priority Data

Mar. 16, 2001 (RU) ..... 007340

(51) Int. Cl.[7] ..... G09F 1/04
(52) U.S. Cl. ..... 40/124.08; 40/124.11
(58) Field of Search ..... 40/124.08, 124.09, 40/124.11, 124.12; 283/117; 446/148, 150

(56) References Cited

U.S. PATENT DOCUMENTS 2,083,912 A * 6/1937 Johntz ..... 40/491
2,943,416 A * 7/1960 Barker ..... 446/148
3,035,363 A * 5/1962 Luchsinger ..... 40/124.08
3,061,971 A * 11/1962 Fites ..... 446/150
5,263,890 A * 11/1993 Dent, IV ..... 446/475

FOREIGN PATENT DOCUMENTS

| | | | |
|---|---|---|---|
| FR | 2282373 | * 10/1969 | ..... 283/117 |
| FR | 2668736 | * 11/1990 | ..... 283/117 |
| FR | 2790423 | * 3/1999 | ..... 283/117 |
| GB | 2336808 | * 11/1999 | ..... 283/117 |

* cited by examiner

*Primary Examiner*—Brian K. Green
(74) *Attorney, Agent, or Firm*—Van Dyke, Gardner, Linn & Burkhart, LLP

(57) ABSTRACT

A printed article including text and/or depictive elements includes an insert that is supported by an elastic thread that is substantially invisible to human vision. This provides the appearance that the insert is suspended or floating when pages of the printed article are opened.

14 Claims, 1 Drawing Sheet

PRINTED ARTICLE WITH FLOATING INSERT

BACKGROUND OF THE INVENTION

The present invention falls into the category of printing materials of a special format or designation and may be used to reinforce the perception of an image and/or a text placed on a postcard, a greeting address, a children's book, advertising materials, or the like.

There exist depictive postcards with one or two folds. There is a drawing, a photo or an illustration on the outer side of the postcard, and the inner side may be used as a space for a message or a text explaining the image.

The disadvantage of this print work is the lack of reinforcement of the depictive and written information contained in the print work.

There also exists a legal document having the outer cover, first inner page, second inner page with a fixing device and a charm secured on the lower part of the outer protective cover; while on the hinder outer surface of the second inner page as well as on the outer page of the outer protective cover, there is advertising information suggesting two variants of reading done in the form of alternating stripes and covered by a transparent ribbed optical surface. Both sides of the charm have advertising information in form of a text and/or graphic image.

The disadvantage of this invention is that the element designated to attract the attention of the recipient of the information, namely the charm, initially placed in between the pages falls out when the cover is opened and remains hanging outside without returning to its original location. This means that the effect of appearing of the charm takes place only once after the cover is opened. Thus, the efficiency of attracting the customer's attention is lessened.

SUMMARY OF THE INVENTION

The technological result of the presented invention is in boosting the effect from the print work by means of reinforcing of visual perception of depictive and/or written information contained by the print work through the sudden appearance of an additional element, namely an insert, in the space between the pages when they are opened. It is as if the insert is suspended or floating.

A printed article, according to an aspect of the invention, includes a folded sheet, at least two outer faces, and at least two inner faces. Text and/or depictive elements are provided on at least one of the faces. An insert is provided between adjacent ones of the interfaces and an elastic thread supports the insert from at least one sheet.

A printed article, according to another aspect of the invention, includes at least one sheet defining at least two outer faces and at least two inner faces. Text and/or depictive elements are provided on at least one of the faces. An insert is provided between adjacent ones of the inner faces. An elastic thread supports the insert from at least one sheet. The elastic thread is substantially invisible to human vision.

Thus, according to the invention, the print work having two outer pages and two inner pages has an additional insert supported in between the inner pages by means of securing it on an elastic transparent thread, which is stretched by its ends and anchored to the surfaces of both inner pages.

The insert may be flat or volumetric.

When the insert is volumetric, holes or convexities in form of the insert are made on the page-forming sheets.

An elastic thread, for instance, Lycra thread of a diameter that it is substantially invisible to human vision, is stretched and its ends are anchored to the surface of both inner pages of the print work.

There may be depictive elements, such as drawings and/or photos and/or illustrations and/or space for a message on the surface of the outer and inner pages and on the insert.

The analysis of comparing the present invention with the prior art shows that the present invention is distinguished from the prior art by an additional insert placed in the space between the inner pages and secured on an elastic thread anchored by its ends to the surfaces of the inner pages. The insert may be either flat or volumetric.

Also, there may be holes, or recesses, in the shape of the insert on the page-forming sheets if the insert is volumetric.

Also, there may be drawings and/or photos and/or illustrations and/or text placed on the outer and inner pages and on the insert.

These and other objects, advantages and features of this invention will become apparent upon review of the following specification in conjunction with the drawings.

DETAILED DESCRIPTION OF THE PREFERRED EMBODIMENT

Figure 1:
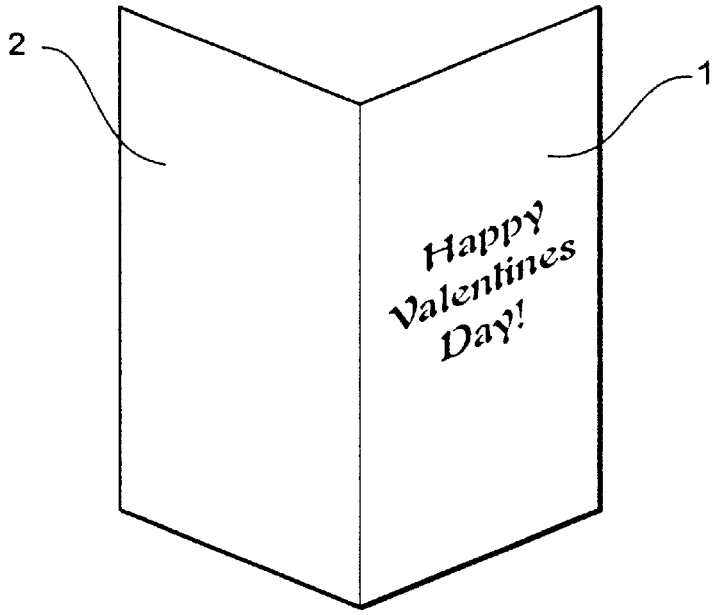
FIG. 1 is a perspective view of printed articles showing outer faces thereof.
Figure 2:
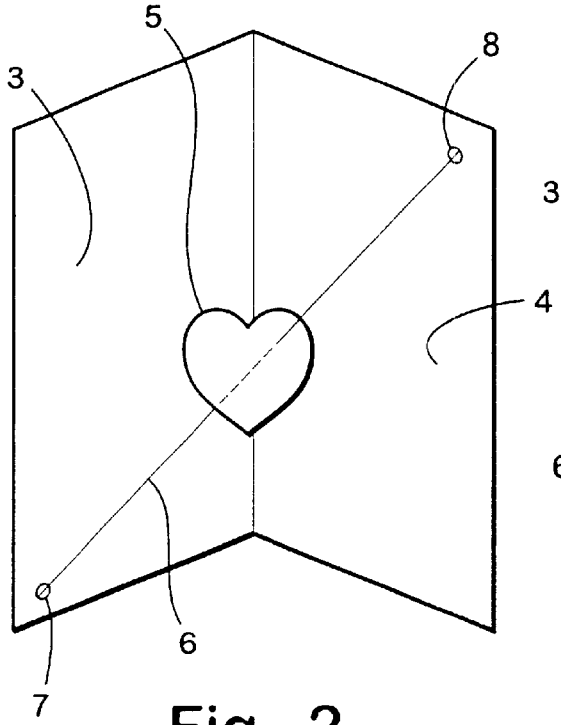
FIG. 2 is a perspective view illustrating the inner faces of the printed article in FIG. 1 as the inner faces are being separated.
Figure 3:
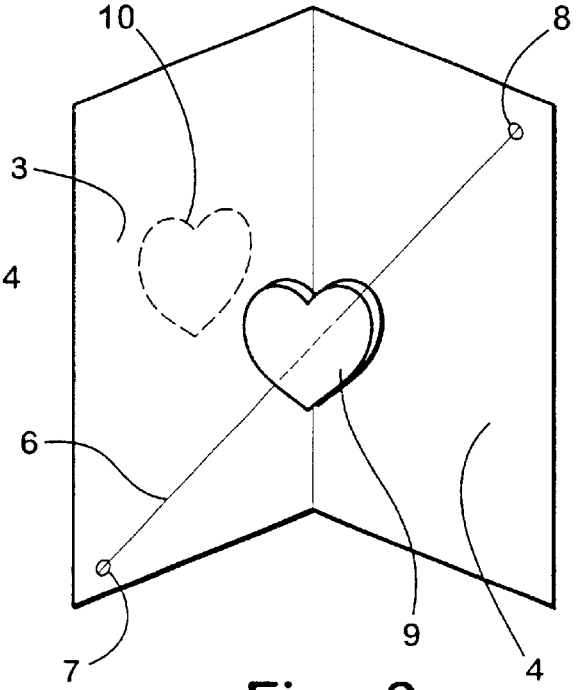
FIG. 3 is the same view as FIG. 2 with the inner faces fully opened.

Referring now to the drawings and the illustrated embodiment depicted therein, a print work includes the outer pages 1 and 2, inner pages 3 and 4, an insert 5 secured on an elastic thread 6, which is stretched and anchored at its ends 7 and 8 to the surface of the inner pages 3 and 4 (FIG. 1). There may be text or depictive elements placed on the surface of the outer pages 1 and 2 and/or inner pages 3 and 4 and/or the insert 5. The insert 5 may be flat, such as illustrated in FIG. 1, or may be volumetric or of three-dimensional configurations. In the latter case, the page-forming sheets 1, 3 and 2, 4 have holes 9, such as shown in FIG. 2, or convexities 10, as shown in FIG. 3, to accommodate the volume of the insert when the printed article is closed.

The print work is used as follows. The customer examines the outer pages 1 and 2 of the postcard with, for instance, a picture and words of greeting on them. When the pages 3 and 4 are opened at an angle of less than 180 degrees, there suddenly appears the insert 5 in the space between the pages, which is secured on the elastic thread 6, anchored at its ends 7 and 8, to the surfaces of the inner pages 3 and 4. Since the elastic thread is substantially transparent and virtually invisible to human vision, the insert seems to be suspended or floating in the air between the pages, thus attracting the attention of the customer and reinforcing the overall effect of the print work.

Depending on the type and purpose of the information placed on the outer and/or inner pages of the edition, the insert may be of decorative and/or informational character. In the latter case, advertising information may be placed on the insert.

The embodiments of the invention in which an exclusive property or privilege is claimed are defined as follows:

1. A printed article, comprising:

a folded sheet defining at least two outer faces and at least two inner faces, said folded sheet having a closed orientation and an opened orientation;

at least one chosen from text and depictive elements on at least one of said faces;

an insert between adjacent ones of said inner faces when said folded sheet is in said closed orientation; and an elastic thread having at least one thread portion supporting said insert away from said at least two inner faces when said folded sheet is in said opened orientation, wherein opposite ends of said elastic thread are directly attached to said at least two inner faces.

2. The printed article in claim 1 wherein said insert is a flat insert.

3. The printed article in claim 1 wherein said insert is a volumetric insert.

4. The printed article in claim 3 including a cutout in said at least one sheet in the shape of said insert.

5. The printed article in claim 1 including a cutout in said at least one sheet in the shape of said insert.

6. The printed article of claim 1 further including at least one chosen from a photograph and an illustration on at least one of said faces.

7. The printed article of claim 1, said insert comprising at least one chosen from text and a depictive element.

8. A printed article, comprising:

at least one sheet defining at least two outer faces and at least two inner faces, said at least one sheet having a closed orientation and an opened orientation;

at least one chosen from text and depictive elements on at least one of said faces;

an insert between adjacent ones of said inner faces when said at least one sheet is in said closed orientation; and an elastic thread having at least one thread portion supporting said insert away from said at least one sheet, wherein opposite ends of said elastic thread are directly attached to said at least two inner faces, said elastic thread being substantially invisible to human vision.

9. The printed article in claim 8 wherein said insert is a flat insert.

10. The printed article in claim 8 wherein said insert is a volumetric insert.

11. The printed article in claim 10 including a cutout in said at least one sheet in the shape of said insert.

12. The printed article in claim 8 including a cutout in said at least one sheet in the shape of said insert.

13. The printed article of claim 8 further including at least one chosen from a photograph and an illustration on at least one of said faces.

14. The printed article of claim 8 further including at least one chosen from a photograph and an illustration on at least one of said faces.

* * * * *